US008152527B2

(12) United States Patent
Kobett

(10) Patent No.: US 8,152,527 B2
(45) Date of Patent: Apr. 10, 2012

(54) GUN AIMING METHOD

(76) Inventor: Kevin Kobett, Savannah, MO (US)

( * ) Notice: Subject to any disclaimer, the term of this patent is extended or adjusted under 35 U.S.C. 154(b) by 0 days.

(21) Appl. No.: 12/657,631

(22) Filed: Jan. 25, 2010

(65) Prior Publication Data

US 2010/0140874 A1 Jun. 10, 2010

Related U.S. Application Data

(63) Continuation of application No. 12/154,543, filed on May 23, 2008, now abandoned.

(60) Provisional application No. 60/931,689, filed on May 25, 2007.

(51) Int. Cl.
*F41G 3/26* (2006.01)
*F41J 1/10* (2006.01)

(52) U.S. Cl. ..... 434/19; 273/407

(58) Field of Classification Search ..... 273/359–371, 273/403–410; 434/19
See application file for complete search history.

(56) References Cited

U.S. PATENT DOCUMENTS

| | | | | | |
|---|---|---|---|---|---|
| 2,398,813 | A * | 4/1946 | Swisher | 273/369 |
| 2,519,402 | A * | 8/1950 | Ruiz et al. | 434/14 |
| 4,112,583 | A * | 9/1978 | Castilla | 42/141 |
| 4,223,446 | A * | 9/1980 | Villa | 42/141 |
| 5,281,142 | A * | 1/1994 | Zaenglein, Jr. | 434/19 |
| 5,321,263 | A * | 6/1994 | Filo | 250/316.1 |
| 5,417,573 | A * | 5/1995 | Cassiere et al. | 434/21 |
| 5,641,288 | A * | 6/1997 | Zaenglein, Jr. | 434/21 |
| 6,349,497 | B1 | 2/2002 | Roddenbery | 43/2 |
| 7,845,646 | B1 * | 12/2010 | Weber | 273/407 |

* cited by examiner

*Primary Examiner* — Mark Graham
(74) *Attorney, Agent, or Firm* — John M. Harrison

(57) ABSTRACT

A method of practicing aiming of a gun at a moving target includes providing a first simulated target, providing a second simulated target in spaced-apart relationship with respect to the first simulated target, providing a gun, positioning the gun with respect to the first simulated target and the second simulated target and repeatedly aiming the gun at the second simulated target while visually focusing on the first simulated target. The first simulated target represents a position of the moving target upon shooting of shot from the gun. The second simulated target represents a position of the moving target upon striking of the moving target with the shot.

16 Claims, 7 Drawing Sheets

GUN AIMING METHOD

CROSS-REFERENCE TO RELATED APPLICATIONS

This is a continuation of and incorporates by reference in its entirety U.S. application Ser. No. 12/154,543,filed May 23, 2008 now abandoned and entitled "Stationary Target Assembly", which claims the benefit of U.S. Provisional Patent Application No. 60/931,689,dated May 25, 2007.

FIELD

The present disclosure relates to targets used in the practice of aiming guns. More particularly, the present disclosure relates to a stationary target assembly and practice in the mounting and aiming of a gun at a moving target using the stationary target assembly.

BACKGROUND

Shooting of a moving target such as a clay pigeon or a flying fowl with a shotgun requires a high degree of skill in mounting and aiming of the shotgun at the target. A shooter may have a tendency to either shoot behind or ahead of the moving target, particularly in the case of a fast-moving target such as a clay pigeon. Therefore, consistent timing of the mounting and aiming of the shotgun and pulling of the trigger with striking of the target typically requires repetitive practice in mounting and aiming of the shotgun.

Accordingly, a stationary target assembly and a gun aiming method are needed which facilitate practice in the mounting and aiming of a gun at a moving target.

SUMMARY

The disclosure is generally directed to a method of practicing aiming of a gun at a moving target. An illustrative embodiment of the method includes providing a first simulated target, providing a second simulated target in spaced-apart relationship with respect to the first simulated target, providing a gun, positioning the gun with respect to the first simulated target and the second simulated target and repeatedly aiming the gun at the second simulated target while visually focusing on the first simulated target. The first simulated target represents a position of the moving target upon shooting of shot from the gun. The second simulated target represents a position of the moving target upon striking of the moving target with the shot.

BRIEF DESCRIPTION OF THE DRAWINGS

The disclosure will now be made, by way of example, with reference to the accompanying drawings, in which.

DETAILED DESCRIPTION

Figure 1:
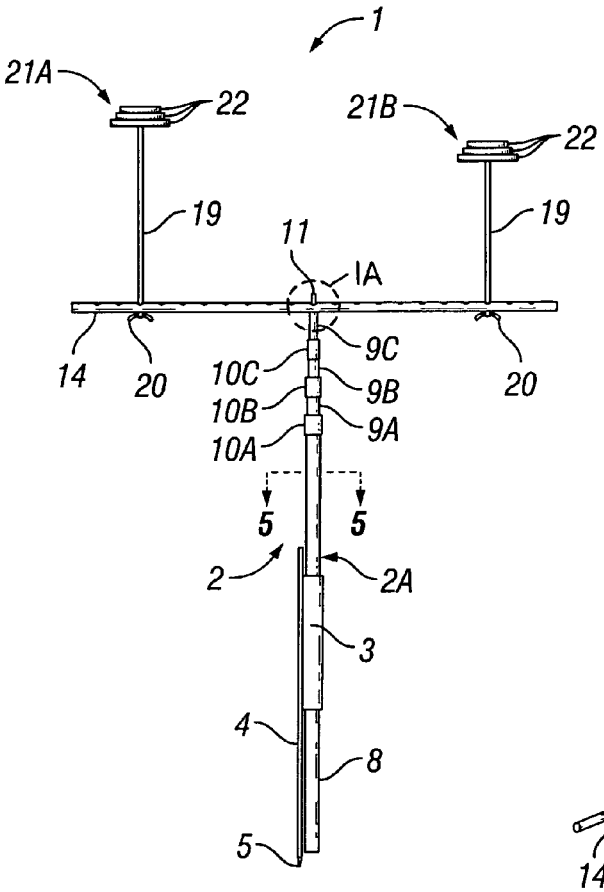
FIG. 1 is a front view of an illustrative embodiment of the stationary target assembly.

Referring initially to FIGS. 1-10 of the drawings, an illustrative embodiment of the stationary target assembly is generally indicated by reference numeral 1. The stationary target assembly 1 includes an assembly support frame 2 having a generally elongated main frame member 2*a* and a generally elongated target support frame member 14 which is provided on the main frame member 2*a*. The longitudinal axis of the target support frame member 14 may be oriented in generally perpendicular relationship with respect to the longitudinal axis of the main frame member 2*a*. At least one simulated target 21 is provided on the target support frame member 14. In typical application of the stationary target assembly 1, which will be hereinafter described, a first simulated target 21*a* and a second simulated target 21*b* are provided on the target support frame member 14 at a selected lead spacing with respect to each other. A practice shooter (not illustrated) stands at a distance from the stationary target assembly 1 and repeatedly mounts and aims a shotgun 26 (FIGS. 9 and 10) first at the first simulated target 21*a* and then at the second simulated target 21*b* in motions which simulate sighting of a clay pigeon or other moving target preparatory to shooting of the moving target with the shotgun 26. The first target 21*a* represents the position of the moving target when the trigger of the shotgun is depressed, whereas the second simulated target 21*b* represents the position of the moving target when the pellets (not illustrated) from the shotgun reach the moving target. Therefore, repeated sighting of the first simulated target 21*a* and the second simulated target 21*b* by the practice shooter facilitates training of the practice shooter in accurately shooting a moving target the positions of which generally correspond to the positions of the first simulated target 21*a* and the second simulated target 21*b* when the trigger of the shotgun 26 is depressed and the pellets from the shotgun reach the moving target, respectively. Each simulated target 21 may be detachable with respect to the target support frame member 14 to facilitate placement of the simulated targets 21*a* at a selected lead spacing with respect to each other as will be hereinafter described.

The main frame member 2*a* of the assembly support frame 2 includes a generally elongated base frame member 8. The target support frame member 14 is attached to the assembly support frame 2 typically in a manner which will be hereinafter described. In some embodiments, the base frame member 8 extends through a frame mount sleeve 3. A stake 4, having a stake insertion tip 5, extends from the frame mount sleeve 3. In typical application of the stationary target assembly 1, which will be hereinafter described, the stake 4 is inserted in the ground 24 (FIG. 8) to support the stationary target assembly 1 in a generally vertical, upward-standing configuration. However, other techniques known by those skilled in the art may be used to support the stationary target assembly 1 in an upward-standing configuration on the ground 24 or other support surface (not illustrated).

Figure 2:
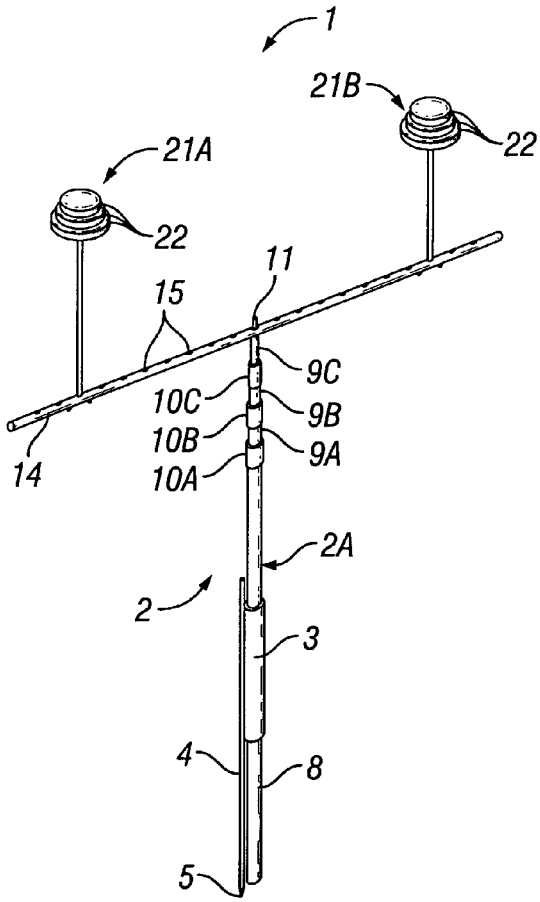
FIG. 2 is a perspective view of the stationary target assembly.
Figure 3:
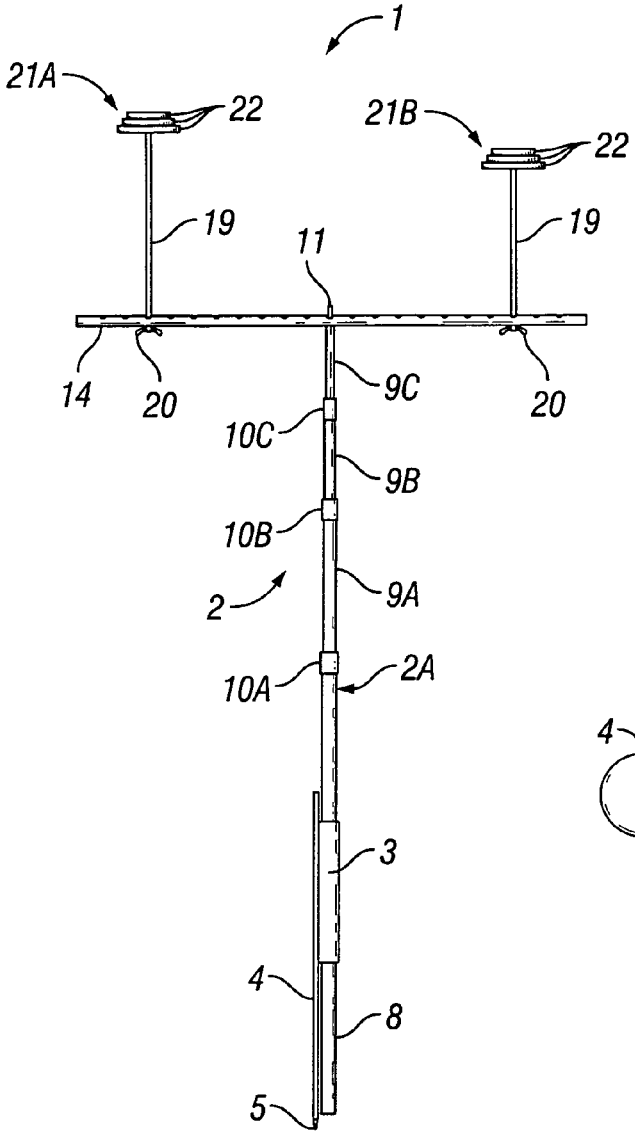
FIG. 3 is a front view of the stationary target assembly, more particularly illustrating a vertical adjustment capability of the assembly.
Figure 5:
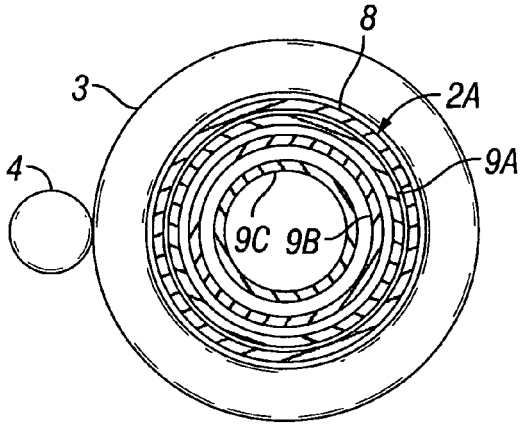
FIG. 5 is a cross-sectional view, taken along section lines 5-5 in FIG. 1, of a main frame member of the assembly.
Figure 8:
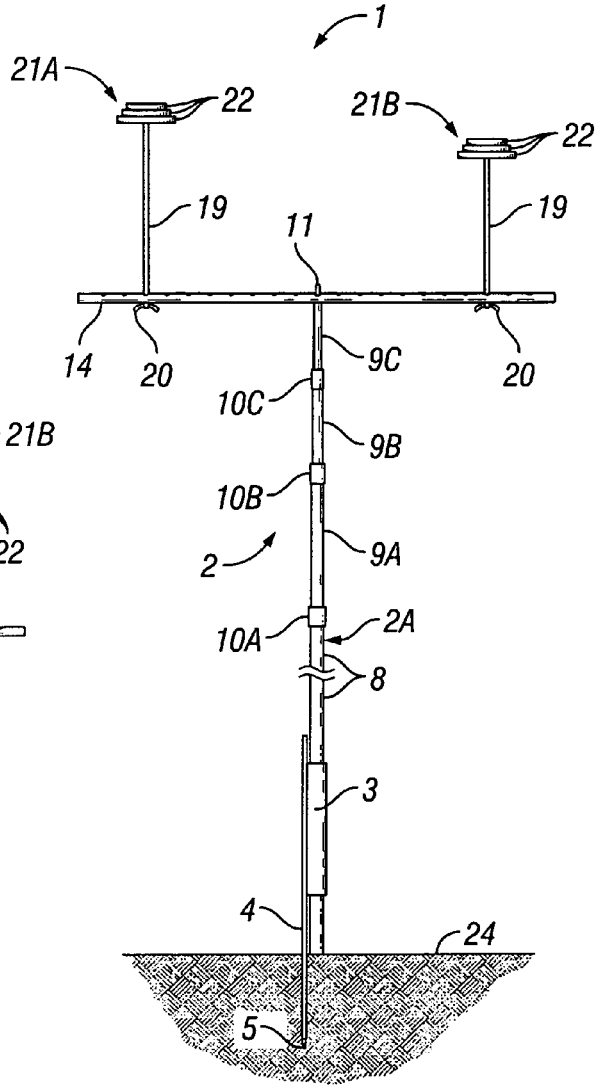
FIG. 8 is a front view (partially in section) of the stationary target assembly, with a stake element of the stationary target assembly inserted in the ground in typical application of the assembly.

In some embodiments, the main frame member 2*a* of the assembly support frame 2 is height-adjustable and may be selectively deployed in the extended configuration illustrated in FIGS. 3 and 8 or the collapsed configuration illustrated in FIG. 1, depending on the desired height of the simulated target or targets 21 above the ground 24 (FIG. 8) or other support surface (not illustrated). Accordingly, at least one frame extension 9 is telescopically extendable from the base frame member 8. The target support frame member 14 is attached to the frame extension or extensions 9 typically in a manner which will be hereinafter described. In the embodiment of the support frame 2 illustrated in FIGS. 1-8, a first frame extension 9*a* is telescopically extendable from the base frame member 8; a second frame extension 9*b* is telescopically extendable from the first frame extension 9*a*; and a third frame extension 9*c* is telescopically extendable from the second frame extension 9*b*. The target support frame member 14 is provided on the third frame extension 9*c*. However, it will be appreciated by those skilled in the art that any number of frame extensions 9 may be provided between the base frame member 8 and the target support frame member 14 depending on the desired height adjustability of the main frame member 2*a*. Therefore, the length or height of the main frame member 2*a* may be selected by extending a selected length of the first frame extension 9*a* from the base frame member 8; a selected length of the second frame extension 9*b* from the first frame extension 9*a*; and a selected length of the third frame extension 9*c* from the second frame extension 9*b*. The first frame extension 9*a*, the second frame extension 9*b* and the third frame extension 9*c* may be secured at the selected extended lengths by, for example, selective rotation of a first lock sleeve 10*a*; a second lock sleeve 10*b*; and a third lock sleeve 10*c* which are provided on the base frame member 8, the first frame extension 9*a* and the second frame extension 9*b*, respectively. In the cross-sectional view of the main frame member 2*a* which illustrated in FIG. 5, the main frame member 2*a* is deployed in the collapsed configuration with the first frame extension 9*a*; the second frame extension 9*b*; and the third frame extension 9*c* disposed inside the base frame member 8.

Figure 1A:
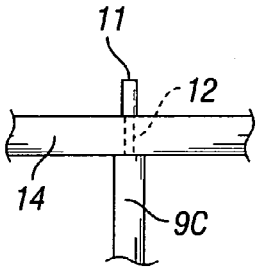
FIG. 1A is an enlarged sectional view, taken along section line 1A in FIG. 1, more particularly illustrating an exemplary technique for attaching a target support frame member to a frame extension of the stationary target assembly.

The target support frame member 14 may be attached to the frame extension or extensions 9 according to any suitable technique which is known by those skilled in the art. As indicated by the arrow in FIG. 4, in some embodiments, the target support frame member 14 is rotatably mounted with respect to the third frame extension 9*c*. Accordingly, as illustrated in FIG. 1A, a mount pin 12 (illustrated in phantom) extends from the third frame extension 9*c*. The mount pin 12 further extends through a mount pin opening (not illustrated) provided in the target support frame member 14. A mount pin cap 11 may be threadably or otherwise attached to the protruding end portion of the mount pin 12 to secure the target support frame member 14 to the third frame extension 9*c*.

Figure 4:
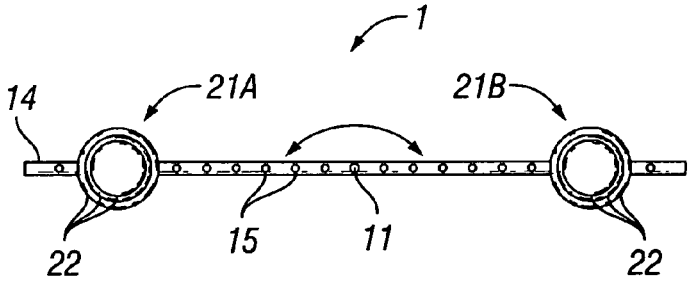
FIG. 4 is a top view of the stationary target assembly, more particularly illustrating a swivel attachment of a target support frame member to an assembly support frame (not illustrated) of the assembly.
Figure 6:
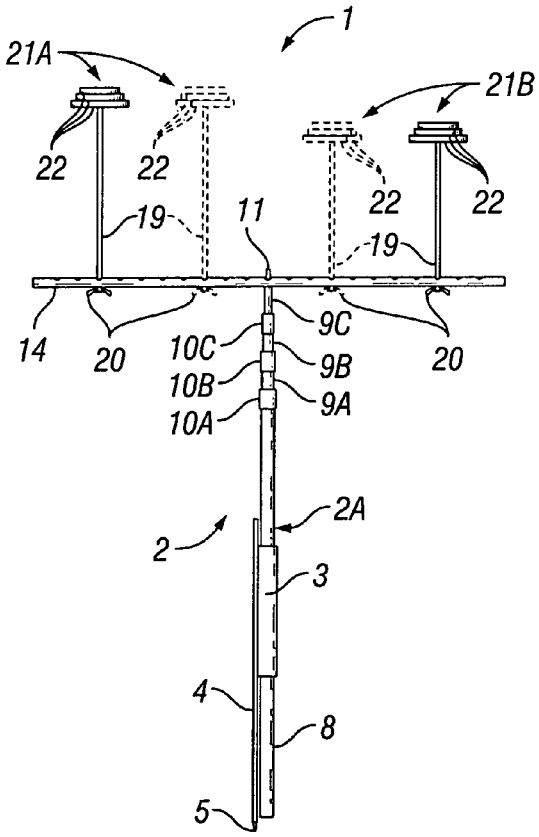
FIG. 6 is a front view of the stationary target assembly, more particularly illustrating variable placement capability of a pair of targets on the target support frame member of the assembly.
Figure 7:
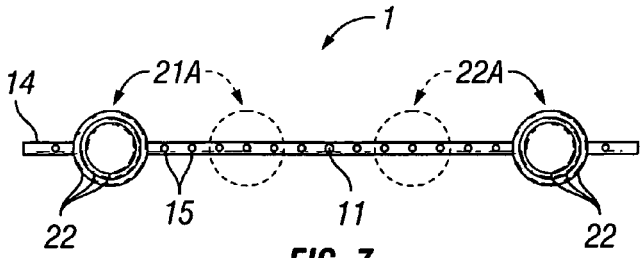
FIG. 7 is a top view of the stationary target assembly, more particularly illustrating variable placement capability of the targets on the target support frame member of the assembly.

Each simulated target 21 may be attached to the target support frame member 14 according to any suitable technique which is known by those skilled in the art. For example, each simulated target 21 may be provided on a first end of a corresponding target support rod 19 which extends from the target support frame member 14 and is attached to the target support rod 19 according to the knowledge of those skilled in the art. As illustrated in FIGS. 2 and 4, multiple target rod mount openings 15 may extend through the target support frame member 14 at spaced-apart intervals with respect to each other, on each side of the mount pin cap 11. The target support rod 19 of the first simulated target 21*a* and the target support rod 19 of the second simulated target 21*b* extend through respective target rod mount openings 15, typically on respective sides of the mount pin cap 11. A wing nut 20 may be threaded on a second end of each target mount rod 19 and tightened against the target support frame member 14 to secure the target mount rod 19 to the target support frame member 14. The longitudinal axis of each target mount rod 19 may be disposed generally in the same plane as the longitudinal axis of the main frame member 2*a* and the longitudinal axis of the target support frame member 14 of the assembly support frame 2. As illustrated in FIGS. 6 and 7, the first simulated target 21*a* and the second simulated target 21*b* may be re-positioned on the target support frame member 14 at a selected lead spacing with respect to each other by unthreading the wing nuts 20 from the respective target support rods 19; removing the target support rods 19 from the respective target rod mount openings 15; relocating the target support rods 19 and simulated targets 21 to the new positions indicated by the phantom lines in FIGS. 6 and 7; inserting the target support rods 19 through a second pair of target rod mount openings, respectively, which correspond to the new positions; and threading the wing nuts 20 back onto the respective target mount rods 19.

Each simulated target 21 may generally resemble the appearance of a clay pigeon and may include at least one or multiple concentric target disks 22 disposed in a stacked or stepped configuration with respect to each other. As illustrated in FIGS. 1-3, in some embodiments, the largest of the target disks 22 is provided on the first end of the target support rod 19. The other target disks 22 of progressively descending diameter are stacked on the largest target disk 22. In some embodiments, a standard or conventional clay pigeon (not illustrated) can be placed on the target support rod 19 such as, for example, by drilling an opening (not illustrated) in the clay pigeon and inserting the upper end of the target support rod 19 into the opening.

Figure 9:
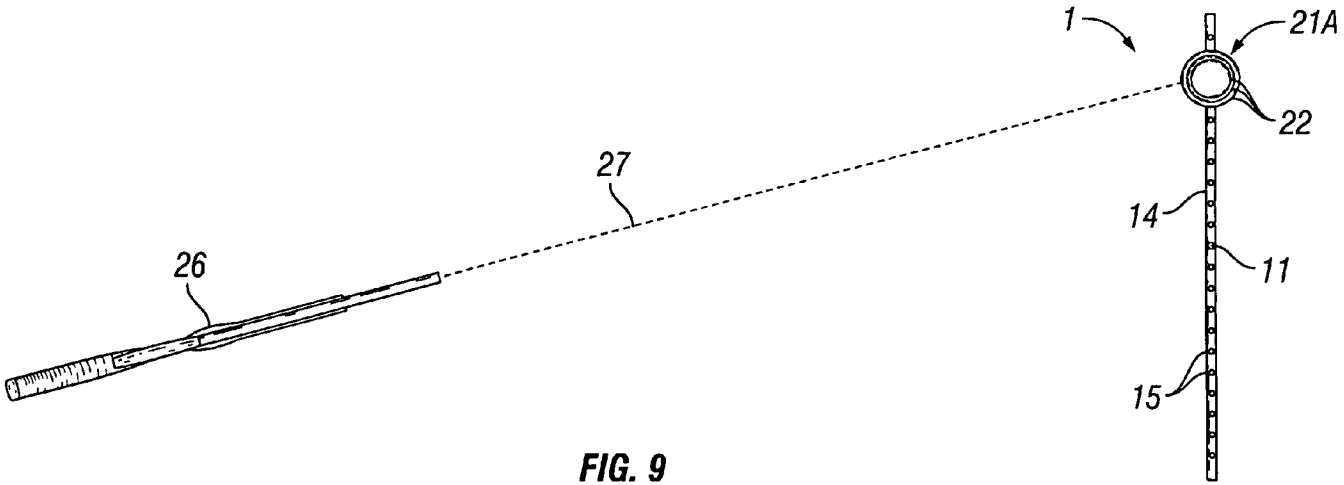
FIG. 9 is a top view of the stationary target assembly, more particularly illustrating aiming of a shotgun at a first target on the stationary target assembly in typical application of the stationary target assembly.
Figure 10:
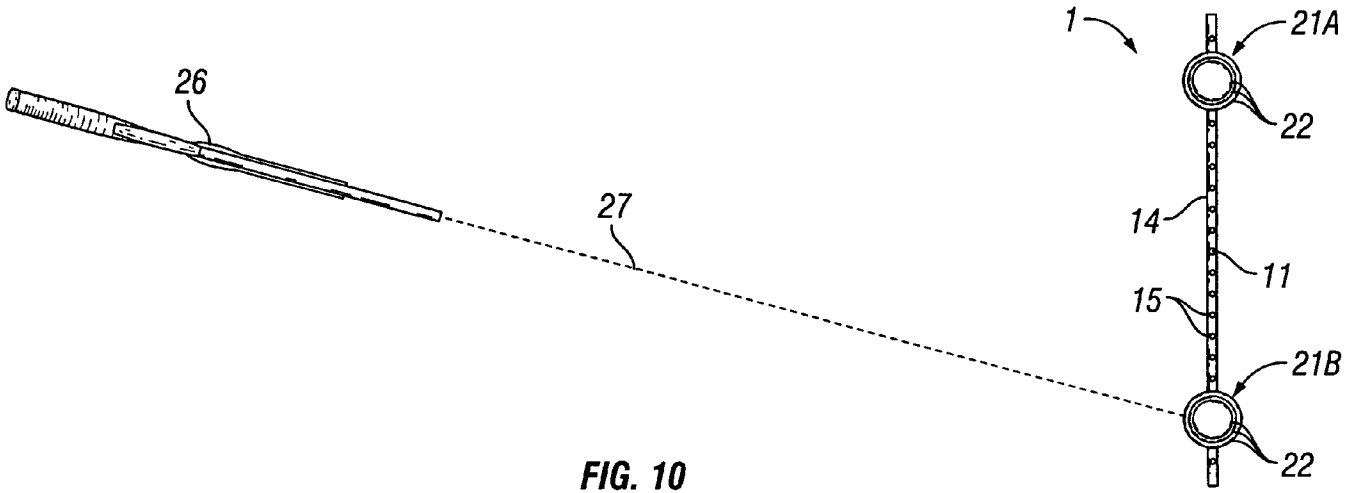
FIG. 10 is a top view of the stationary target assembly, more particularly illustrating aiming of a shotgun at a second target on the stationary target assembly in typical application of the stationary target assembly.

Referring next to FIGS. 8-10 of the drawings, in typical application, the stationary target assembly 1 is deployed in generally vertical or upward-standing relationship with respect to the ground 24 (FIG. 8) or other support (not illustrated), preparatory to a practice shooter's (not illustrated) aiming of a shotgun 26 (FIGS. 9 and 10) at one or both simulated targets 21 in a simulated sighting of a clay pigeon or other moving object (not illustrated) with the shotgun 26. Accordingly, as illustrated in FIG. 8, the stake insertion tip 5 of the stake 4 is inserted in the ground 24, with the lower end of the base frame member 8 typically resting on the surface of the ground 24. The height of the main frame member 2*a* of the assembly support frame 2 may be selected to support the first simulated target 21*a* and the second simulated target 21*b* at the selected height above the ground 24 typically by telescopic extension of the frame extension or extensions 9 from the base frame member 8 and each other and locking of the frame extension or extensions 9 at the selected extended lengths typically by rotation of the lock sleeve or sleeves 10.

As illustrated in FIG. 8, the first simulated target 21*a* is assembled on the target support frame member 14 typically by extending the target support rod 19 through a selected one of the spaced-apart target rod mount openings 15 provided in the target support frame member 14 and threading a wing nut 20 (FIG. 1) on the target support rod 19. The second simulated target 21*b* may initially be removed or omitted from the target support frame member 14. A bead sight (not illustrated), which may be fluorescent, may be positioned on the shotgun 26. The practice shooter (not illustrated) grips the shotgun 26 (FIG. 9) and stands at a selected distance (such as 33 yards, for example) from the first simulated target 21*a* of the stationary target assembly 1, mounts the shotgun 26 and aims the shotgun 26 at the first simulated target 21*a* along a straight sight line 27. The practice shooter repeats this action until he or she is proficient at mounting and aiming of the shotgun 26 at the first simulated target 21*a*.

Next, with both of his or her eyes open, the practice shooter stares at the first simulated target 21*a* for a selected period of time, such as 5 seconds, for example, and mounts the shotgun 26 without taking his or her eyes off the first simulated target 21*a*. The practice shooter may then squeeze the trigger (not illustrated) of the shotgun 26 with the safety (not illustrated) of the shotgun 26 in the "on" position or with a snap cap (not illustrated) in the chamber (not illustrated) of the shotgun 26. Before dismounting of the shotgun 26, the practice shooter closes his or her non-shooting eye and verifies that the bead sight (not illustrated) of the shotgun 26 is directed toward the first simulated target 21 a and repeats this action. In the event that the bead is not directed toward the first simulated target 21*a*, the practice shooter ensures that the shooting eye is the dominant eye. The practice shooter focuses on the first simulated target 21*a* with his or her peripheral vision to ensure that the bead sight on the shotgun 26 covers the first simulated target 21*a*. This action may be repeated until the practice shooter ensures that the location of the bead sight coincides with the location of the practice shooter's stare at the first simulated target 21*a*.

When the practice shooter becomes proficient at mounting and aiming of the shotgun 26 at the first simulated target 21*a*, the second simulated target 21*b* may be assembled on the target support frame member 14. In mounting of the second simulated target 21*b* with the first simulated target 21*a* on the target support frame member 14, the position of the first simulated target 21*a* represents the position which would correspond to the position of a moving object when the trigger of the shotgun 26 is pulled and the position of the second simulated target 21*b* represents the position which would correspond to the position of the moving object when the pellets from the shotgun 26 reach the moving object. The lead spacing between the first simulated target 21*a* and the second simulated target 21*b* may depend on the speed of the moving object which is represented by the simulated targets 21.

As illustrated in FIG. 10, the practice shooter (not illustrated) visually focuses on the first simulated target 21*a* while mounting the shotgun 26 and aiming the shotgun 26 at the second simulated target 21*b* using the practice shooter's peripheral vision. This focused view (shot picture) of the first simulated target 21*a* is held in the practice shooter's field of vision for typically a one-second delay before the practice shooter pulls the trigger (not illustrated) of the shotgun 26. The typically one-second delay trains the practice shooter to place the shotgun 26 in the proper position in an actual shooting situation and may be repeated to entrain this proper position of the shotgun 26 into the practice shooter's mind. The practice shooter may walk around the stationary target assembly 1 and learn the shot pictures for various angles, in a similar manner. Next, the bead sight (not illustrated) may be removed from the shotgun 26 and the mounting and aiming steps which were outlined herein above with respect to FIGS. 9 and 10 repeated to further train the practice shooter's ability to mount the shotgun 26 and aim the shotgun 26 at the moving target without the use of the bead sight.

Figure 11:
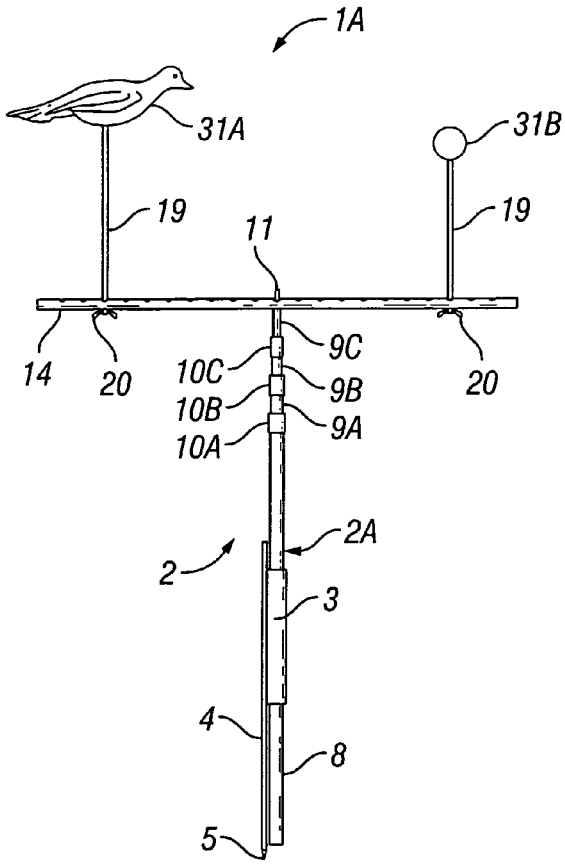
FIG. 11 is a front view of an alternative illustrative embodiment of the stationary target assembly, with a first target shaped in the configuration of a fowl and a second target shaped in the configuration of a sphere provided on the target support frame member of the assembly.
Figure 12:
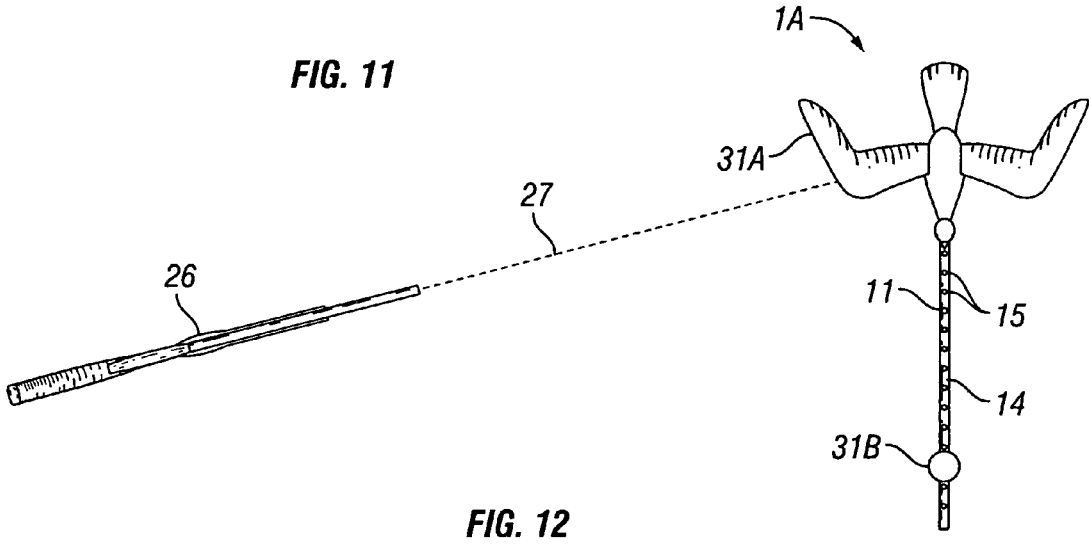
FIG. 12 is a top view of the stationary target assembly illustrated in FIG. 11, more particularly illustrating aiming of a shotgun at the first target on the stationary target assembly in typical application of the stationary target assembly.
Figure 13:
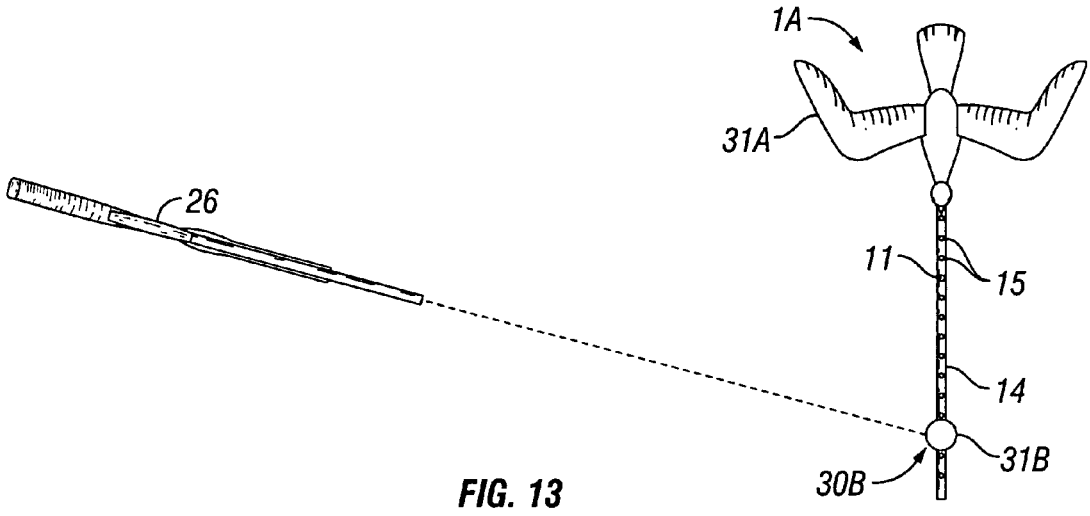
FIG. 13 is a top view of the stationary target assembly illustrated in FIG. 11, more particularly illustrating aiming of a shotgun at the second target on the stationary target assembly in typical application of the stationary target assembly.
Figure 14:
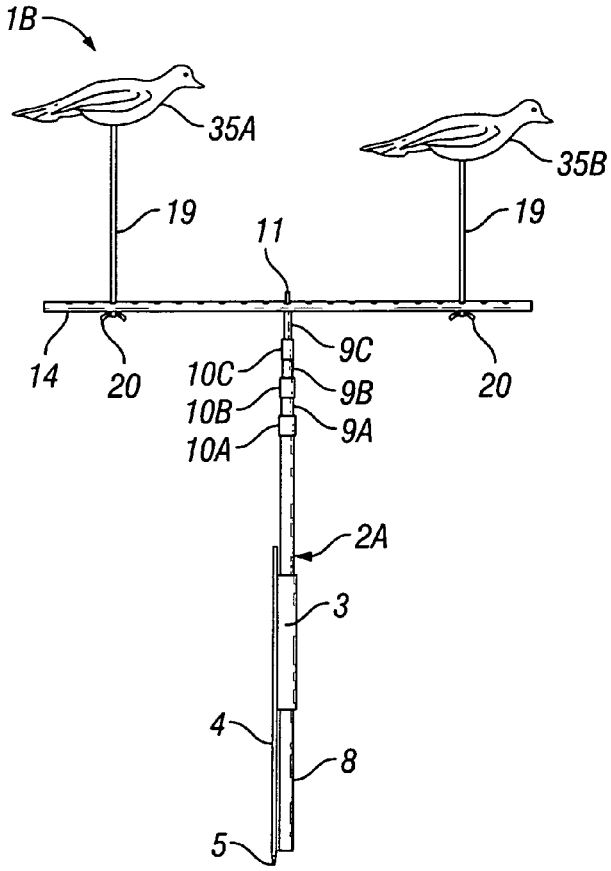
FIG. 14 is a front view of another alternative illustrative embodiment of the stationary target assembly, with first and second targets shaped in the configuration of a water fowl provided on the target support frame member of the assembly.

Referring next to FIGS. 11-14 of the drawings, it will be appreciated by those skilled in the art that the first simulated target 31*a* (such as in the stationary target assembly 1*a* illustrated in FIGS. 11-13), or both the first simulated target 35*a* and the second simulated target 35*b* (such as in the stationary target assembly 1*b* illustrated in FIGS. 14), may simulate the appearance of a game fowl, for example. Accordingly, the fowl-configured simulated targets may be assembled on the target support frame member 14, and the stationary target assembly 1*a* and 1*b* used typically in the manner which was heretofore described with respect to the stationary target assembly 1 in FIGS. 8-10, to train a practice shooter in mounting and aiming the shotgun 26 at a flying fowl (not illustrated) in fowl hunting. As illustrated with respect to the stationary target assembly 1*a* illustrated in FIG. 11, the second simulated target 31*b* may be configured in the shape of a sphere to enable the practice shooter to further differentiate between the first simulated target 31*a* and the second simulated target 31*b* during the training exercise. The stationary target assembly 1*a* may be used to train a practice shooter (not illustrated) in the mounting and aiming of a shotgun 26 at the first simulated target 31*a* and the second simulated target 31*b*, as illustrated in FIGS. 12 and 13 and as was heretofore described with respect to the simulated target assembly 1 which was heretofore described with respect to FIGS. 8-10.

Figure 15:
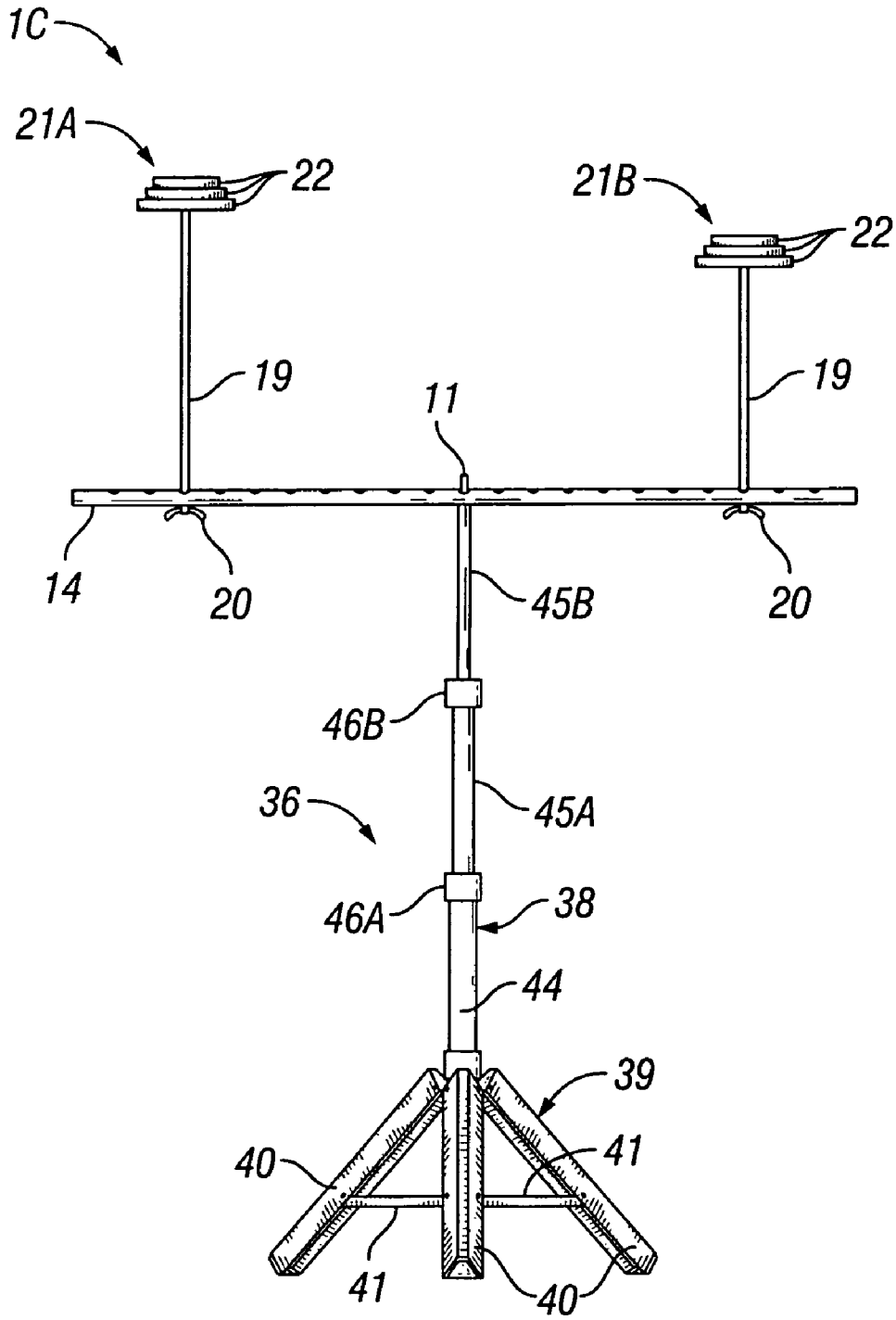
FIG. 15 is a front view of an illustrative tripod embodiment of the stationary target assembly.

Referring next to FIG. 15 of the drawings, still another illustrative embodiment of the stationary target assembly is generally indicated by reference numeral 1*c*. The stationary target assembly 1*c* has an assembly support frame 36 which includes a main frame member 38 having a tripod 39 with three tripod legs 40. Pivoting leg connectors 41 may connect the tripod legs 40. A generally elongated base frame member 44 extends from the tripod 39. At least one frame extension 45 is telescopically extendable from the base frame member 44. In some embodiments, a first frame extension 45*a* is telescopically extendable from the base frame member 44 and a second frame extension 45*b* is telescopically extendable from the first frame extension 45*a*. A first lock sleeve 46*a* may be provided on the base frame member 44 and a second lock sleeve 46*b* may be provided on the first frame extension 45*a* to selectively lock the first frame extension 45*a* with respect to the base frame member 44 and the second frame extension 45*b* with respect to the first frame extension 45*a*. Accordingly, the tripod 39 facilitates support of the stationary target assembly 1*c* on a flat support surface (not illustrated).

While the preferred embodiments of the invention have been described above, it will be recognized and understood that various modifications can be made in the invention and the appended claims are intended to cover all such modifications which may fall within the spirit and scope of the invention.

What is claimed is:

1. A method of practicing aiming of a gun at a moving target, comprising:

providing a first simulated target having a target support rod and a plurality of target disks carried by said target support rod;

providing a second simulated target in spaced-apart relationship with respect to said first simulated target;

providing a gun;

positioning said gun with respect to said first simulated target and said second simulated target;

wherein said first simulated target represents a position of said moving target upon shooting a shot of said gun;

wherein said second simulated target represents a position of said moving target upon striking of said moving target with said shot from said gun; and repeatedly aiming said gun at said second simulated target while visually focusing on said first simulated target.

2. The method of claim 1 wherein said providing a first simulated target having a target support rod and a plurality of target disks carried by said target support rod comprises providing a plurality of target disks disposed in a stepped configuration.

3. The method of claim 2 wherein said providing a second simulated target comprises providing a second simulated target having a second target support rod and a second plurality of target disks carried by said second target support rod in a stepped configuration.

4. The method of claim 1 wherein at least one of said disks comprises the appearance of a game fowl.

5. The method of claim 1 wherein at least one of said target disks is shaped in the configuration of a sphere.

6. The method of claim 1 wherein at least one of said target disks comprises the appearance of a game fowl and said at least one of said target disks is shaped in the configuration of a sphere.

7. The method of claim 1 further comprising squeezing a trigger of said gun about one second after aiming said gun at said second simulated target while visually focusing on said target disks.

8. A method of practicing aiming of a gun at a moving target comprising:

providing a first target support rod and a first plurality of target disks carried by said first target support rod;

providing a gun;

positioning said gun with respect to said first plurality of target disks;

wherein said first plurality of target disks represents a position of said moving target upon shooting of shot from said gun; and repeatedly aiming said gun at said first plurality of target discs;

providing a second target support rod and a second plurality of target disks carried by said second target support rod in spaced-apart relationship with respect to said first plurality of target disks;

wherein said second plurality of target disks represents a position of said moving target upon striking of said moving target with said shot from said gun; and repeatedly aiming said gun at said second plurality of target discs while visually focusing on said first plurality of target discs.

9. The method of claim 8 wherein said first plurality of target disks comprises the appearance of game fowls and said second plurality of target disks comprises the configuration of spheres.

10. The method of claim 8 wherein said first plurality of target disks comprises the appearance of game fowls and said second plurality of target disks comprises the appearance of game fowls.

11. The method of claim 8 further comprising squeezing a trigger of said gun about one second after aiming said gun at said second plurality of target disks while visually focusing on said first plurality of target disks.

12. A method of practicing aiming of a gun at a moving target, comprising:

providing an assembly support frame having a main frame member, an elongated target support frame member carried by said main frame member and a plurality of spaced-apart pairs of target rod mount openings provided in said target support frame member;

providing a first simulated target at a first selected one of said spaced-apart pairs of target rod mount openings provided in said target support frame member;

providing a gun;

positioning said gun with respect to said first simulated target;

wherein said first simulated target represents a position of said moving target upon shooting of shot from said gun;

repeatedly aiming said gun at said first simulated target;

providing a second simulated target at a second selected one of said spaced-apart pairs of target rod mount openings provided in said target support frame member in spaced-apart relationship with respect to said first simulated target;

wherein said second simulated target represents a position of said moving target upon striking of said moving target with said shot from said gun; and repeatedly aiming said gun at said second simulated target while visually focusing on said first simulated target.

13. The method of claim 12 further comprising squeezing a trigger of said gun about one second after aiming said gun at said second simulated target while visually focusing on said first simulated target.

14. The method of claim 12 wherein said providing a first simulated target comprises providing a first target support rod at said first selected one of said spaced-apart pairs of target rod mount openings and a first plurality of target disks carried by said first target support rod and said providing a second simulated target comprises providing a second target support rod at said second selected one of said spaced-apart pairs of target rod mount openings and a second plurality of target disks carried by said second target support rod.

15. The method of claim 12 wherein said providing a first simulated target comprises providing a first simulated target simulating the appearance of a game fowl and said providing a second simulated target comprises providing a second simulated target shaped in the configuration of a sphere.

16. The method of claim 12 wherein said providing a first simulated target comprises providing a first simulated target simulating the appearance of a game fowl and said providing a second simulated target comprises providing a second simulated target shaped in the configuration of a game fowl.

* * * * *